United States Patent [19]

Stoddart

[11] Patent Number: 4,783,283

[45] Date of Patent: Nov. 8, 1988

[54] CLEANING COMPOSITIONS

[75] Inventor: Barry Stoddart, Gateshead, England

[73] Assignee: The Procter & Gamble Company, Cincinnati, Ohio

[21] Appl. No.: 866,851

[22] Filed: May 23, 1986

[30] Foreign Application Priority Data

May 28, 1985 [GB] United Kingdom ..... 8513293

[51] Int. Cl.[4] ..... C11D 1/22; C11D 1/37

[52] U.S. Cl. ..... 252/547; 252/558; 252/89.1; 252/173; 252/DIG. 14

[58] Field of Search ..... 252/547, 553, DIG. 14, 252/558, 89.1, 173, 135, 187.24, 541

[56] References Cited

U.S. PATENT DOCUMENTS

| | | | |
|---|---|---|---|
| 3,560,389 | 2/1971 | Hunting | 252/95 |
| 4,576,728 | 3/1986 | Stoddart | 252/102 |
| 4,614,612 | 9/1986 | Reilly et al. | 252/541 |

FOREIGN PATENT DOCUMENTS

| | | |
|---|---|---|
| 0021581 | 5/1980 | European Pat. Off. . |
| 0030401 | 11/1980 | European Pat. Off. . |
| 1329086 | 9/1973 | United Kingdom . |
| 1418671 | 12/1975 | United Kingdom . |

*Primary Examiner*—Josephine Barr

*Attorney, Agent, or Firm*—Leonard Williamson; Richard C. Witte

[57] ABSTRACT

Aqueous cleaning compositions displaying shear thinning behaviour are provided, comprising from 0.1% to 5% by weight $C_{12}$–$C_{15}$ alkyl amine oxides, together with from 0.05 to 0.5% by weight of an alkylated benzene or naphthalene sulfonate, at a weight ratio of amine oxide to alkylated benzene sulfonate of from 2.5:1 to 10:1. Compositions containing alkali metal hypochlorite bleach are disclosed in which the preferred alkylated benzene sulfonate is sodium cumene sulfonate.

15 Claims, No Drawings

CLEANING COMPOSITIONS

FIELD OF THE INVENTION

This invention relates to aqueous cleaning compositions incorporating low levels of amine oxide surfactants and displaying pronounced shear thinning behaviour i.e. exhibiting high visocities at low rates of shear and much lower viscosities at high rates of shear. This type of behaviour is of particular utility in cleaning compositions intended to be applied "as is" to non-horizontal structural surfaces such as walls, and windows and sanitary fittings such as sinks, baths, showers, wash basins and WCs. The invention is especially concerned with aqueous hypochlorite bleach-containing cleaning compositions which are commonly applied to the surfaces of sanitary fittings.

BACKGROUND OF THE INVENTION

It is well known that the higher the viscosity of a liquid composition, the greater will be its residence time when applied to a non-horizontal surface such as a wall. Viscosity can be increased in many ways e.g. by the use of a polymeric organic thickening agent as a component of the composition, by increasing the concentration of dissolved components, by adding solid components which are suspended in the solution or by modifying the characteristics of the dissolved components to create gel phases.

Each of these approaches has its limitations. A polymeric thickening agent, although of value in compositions that are not exposed to aggressive aqueous environments, is not useful where the composition contains a hypochlorite bleach because of the tendency of the hypochlorite to attack the polymer, which leads to the destruction of the latter's thickening capability. Mere increases in the solution concentration of components have a limited effect on solution viscosity and are thus not particularly cost effective. The addition of solid, i.e. non-soluble, components introduces additional complexity, in that settling out or sedimentation on storage has to be avoided, and the physical form of the product is normally limited to an opaque suspension which is not ideal for an aqueous cleaning composition. Modification of the physical characteristics of the dissolved components by interaction to form viscous phases can also introduce limitations on the type and concentration of the components.

In order to overcome the problem of thickener (and bleach) stability in thickened aqueous hypochlorite-containing compositions, a variety of formulations have been proposed. Most of these involve combinations of surfactants that are stable to hypochlorite solution, examples being the compositions disclosed in BP No. 1329086 and BP 1418671, European Published Patent Applications Nos. 21581 and 30401 and French Pat. No. 2355909. Hypochlorite bleach compositions containing surfactant combinations with product viscosity values of up to $\approx$150 mPa.sec are disclosed by the art but the attainment of higher viscosities than this is not specifically taught and is believed to require surfactant levels that are likely to be unattractive economically.

It has been found by the Applicants that shear thinning behaviour is a desirable characteristic for thickened aqueous hypochlorite-containing compositions intended for use on non horizontal ceramic surfaces. Sheat thinning allows the development of very high viscosities at the low rates of shear which are produced as a result of the movement of a liquid down a vertical surface under its own weight, whilst giving rise to low viscosities when the solution is dispensed under pressure through a restricted orifice such as the neck of a flexibility sided bottle. The commonly assigned Stoddart U.S. Pat. No. 4,576,728 discloses compositions displaying this characteristic which compositions comprise aqueous solutions of long chain amine oxides in combination with certain aromatic compounds having a carboxylic or hydroxylic functionality and possessing a defined amphiphilic character. However, it has also been found that thickened liquid compositions incorporating low levels of one or more additives to produce shear thinning, also show a tendency towards viscoelastic behaviour, particularly at temperatures in the range 5°–20° C. commonly encountered in e.g. toilet bowls. This is a less desirable characteristic as it results in uneven distribution of the liquid over the treated surface. It is also less attractive aesthetically to the consumer. Accordingly there is a need for a thickened aqueous cleaning composition displaying shear thinning characteristics whilst exhibiting controlled, or more preferably substantially no viscoelastic behaviour.

SUMMARY OF THE INVENTION

According to the present invention there is provided a thickened aqueous cleaning composition comprising (a) from 0.1% to 5% by weight of a tertiary amine oxide of formula $R_1R_2R_3N\rightarrow O$ wherein $R_1$ is a $C_{12}$–$C_{15}$ linear or branched alkyl group and $R_2$ and $R_3$ are independently selected from $C_1$–$C_4$ alkyl groups and $C_2$–$C_4$ hydroxyl alkyl groups, (b) from 0.05% to 0.5% by weight of an alkali metal or alkaline earth metal mono- or polyalkylated benzene or naphthalene sulfonate in which the alkyl groups contain from 1 to 4 carbon atoms;

(c) from 0% to 25% by weight of ionisable non surface active organic, or inorganic compounds;

the weight ratio of a:b lying in the range from 2.5:1 to 10:1 said composition exhibiting a zero shear viscosity of at least 500 mPa.sec at 10° C., a Brookfield viscosity of less than 500 mPa sec using a No. 3 spindle at 100 rpm at 20° C., and a modal relaxation time of 0.5 secs maximum at 10° C.

For the purposes of the present invention the rheological characteristics of the thickened aqueous cleaning compositions are determined using (a) A Brookfield Synchrolectric Viscometer Model RVT made by Brookfield Engineering Laboratories Inc. Stoughton, Massachusetts, U.S.A. The Viscometer uses a No. 3 spindle at 100 rpm and reading are made at 20° C.

(b) A Carrimed Controlled Stress Rheometer made by Carrimed Ltd., Interpret House, Curtis Road. Industrial Estate, Dorking, Surry RH 4 1DP, England. The Rheometer employs Carrimed oscillatory shear computer software, with cone and plate shear geometry (cone diameter: 4 cm; cone angle; 2°) normally set to provide a shear stress of 8.94 dyne $cm^{-2}$ over an oscillatory frequency range of 0.063–6.3 radians $sec^{-1}$. Measurements on this instrument are carried out at temperatures of 6°, 10°, 14° and 18° C.

The Rheometer measures two parameters of thickened aqueous compositions in accordance with the invention as a function of oscillation frequency, viz, the inphase component of complex viscosity (mPa sec) and the rigidity modulus (Pa), each of which parameters have the meanings given to them in 'Viscoelastic properties of polymers' by J. D. Ferry (3rd Edition) published by Wiley & Sons in 1980. The Applicants have found that the variation of a derived function of at least one of these parameters, viz, the in phase component of complex viscosity, correlates with the consumer perception of the viscoelasticity of thickened aqueous compositions at temperatures in the range from 5° C. to 20° C.

The zero shear viscosity is taken as the low frequency asymptote of the in-phase component of complex viscosity and this value is a measure of the shear thinning nature of the aqueous composition. A measure of the viscoelastic behaviour is obtained by mathematically transforming the in-phase component of complex viscosity. This involves multiplication of the in-phase complex viscosity component by the frequency so as to give a loss modulus value. A plot of this loss modulus against the inverse of the frequency will produce a maximum valve for the loss modulus, and the inverse frequency at this value is taken as the modal relaxation time of the liquid composition. Although the in phase complex viscosity component and the modal relaxation time are not completely independent of each other their relationship is indirect and not clearly defined.

DETAILED DESCRIPTION OF THE INVENTION

In its broadest aspect the invention comprises an aqueous cleaning composition containing two components viz. a long chain amine oxide and an alkali metal or alkaline earth metal salt of a mono or poly alkylated benzene or naphthalene sulfonate in which the alkyl group(s) contain from one to four carbon atoms.

Amine oxides useful in the present invention have the formula $R_1R_2R_3N\rightarrow O$ wherein $R_1$ is a $C_{12}$–$C_{15}$ alkyl group and $R_2$ and $R_3$ are $C_1$–$C_{14}$ alkyl groups. The amine oxide is present in an amount of from about 0.1% to about 5%, more preferably from about 0.5% to about 2.5% and, in preferred embodiments of the invention in which the $R_1$ average chain length is $\geqq 14$ carbon atoms, from about 1% to about 1.5% by weight of the composition. The $R_1$ group may be linear or branched and may be derived from natural or synthetic hydrocarbon sources. For the purposes of the present invention, linear groups are defined as including moieties incorporating up to about 25% methyl branching, predominantly in the 2-position relative to the nitrogen atom of the amine oxide.

Methyl branching on the alkyl chain also predominates in those amine oxides useful in the present invention in which the $R_1$ group is branched, rather than linear in nature.

Commercially available sources of these amine oxides are normally a mixture of

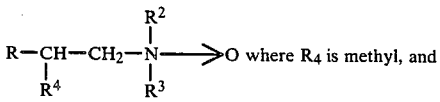

where $R_4$ is methyl, and

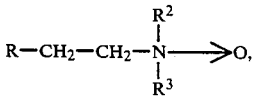

which mixture arises as a result of the processing route used to form the precursor alcohol or aldehyde. This route involves carbonylating or hydroformylating an olefin, preferably a linear α-olefin and leads to a mixture of the desired branched chain aldehyde or alcohol of the same carbon number. For olefin starting materials having a range of carbon chain length, the resultant alcohol or aldehyde mixture contains compounds of different carbon number and isomers containing straight chain and 2-alkyl branched chain alkyl groups. Mixture of linear and branched chain material are available commercially and comprise from about 25 to about 75% by weight $C_{13}$ and from about 75 to about 25% by weight $C_{15}$ amine oxides with approximately 50% by weight straight chain and 50% by weight 2-alkyl branched chain where the 2-alkyl group is predominantly methyl. In thickened cleaning compositions in accordance with the invention the level of usage of the branched chain amine oxides and mixtures thereof with linear chain amine oxides varies, depending on the average chain length of the detergent alkyl group. Where the olefin starting material comprises 65–75% $C_{13}$ and 25–35% $C_{15}$ hydrocarbyl groups, the resulting amine oxides are used at levels towards the upper end of the range viz. $\geqq 2\%$ by weight of the composition and typically from about 2.0% to about 2.5% by weight.

Where the mixture in the starting material is closer to the reverse of that above viz. 65–75% $C_{15}$ and 25–35% $C_{13}$, the level of usage of the resultant amine oxides can be reduced to a value in the range from 1% to 2% by weight of the composition. Furthermore, amine oxides in which the long chain alkyl group $R_1$ is linear are more susceptible than those where $R_1$ is non linear to the effect of the viscosity modification agents useful in the present invention. Thus, a bleaching composition containing 8–10% hypochlorite and an amine oxide in which the long chain alkyl group is branched and has a carbon number of about 13.3 requires an ionic strength of at least 4.7 g moles/dm$^3$ to achieve a product viscosity in excess of 200 mPa. sec. This level of ionic strength is believed to make the storage stability of the hypochlorite bleach less than that which is considered desirable for the expected shelf life of the product. The preferred amine oxide structure for 'thickened' products having a viscosity of $>200$ mPa. sec. at 20° C. is one in which $R_1$ has an average chain length in the range $C_{14}$–$C_{15}$. Compositions containing these preferred amine oxides require a lower amine oxide level viz. $<2.0\%$, more typically 1.0–1.5%, and also a lower ionic strength viz. 3.0 g moles/dm$^3$ minimum in order to achieve target viscosity. Both of these reductions in ingredient level lead to improved storage stability and also lower the cost of the product.

The second essential component of the composition of the invention is an alkali metal or alkaline earth metal salt of a mono- or poly alkylated benzene or naphthalene sulfonate in which the alkyl groups contain from 1 to 4 carbon atoms. Examples of suitable materials include alkali metal toluene, xylene and cumene sulfonates with sodium xylene sulfonate and more especially sodium cumene sulfonate being the most effective materials. The levels of incorporation are such as to provide an amine oxide to alkylated benzene or naphthalene sulfonate weight ratio of from about 2.5:1 to about 10:1 more preferably from about 4:1 to about 10:1. In practice the level of incorporation ranges from about 0.05% to about 0.5% by weight of the composition more preferably from about 0.1% to about 0.25% by weight.

The mode of operation of these materials in the composition of the invention is not understood, although it is believed that they are responsible for some form of association between the amine oxide micelles. This association leads to the production of a loosely bound structure in solution, which displays high viscosity at low shear rates whilst not possessing visco elastic properties.

Compositions in accordance with the invention should have a zero shear viscosity of at least about 500 mPa sec at 10° C. and preferably the zero shear viscosity is greater than about 1000mPa sec more preferably greater than about 2000 mPa sec at this temperature.

The Modal Relaxation time of compositions in accordance with the invention is no more than about 0.5 seconds at 10° C. and is preferably less than about 0.4 seconds. Ideally the modal relaxation time should approach zero.

The Brookfield viscosity at 20° C. using the No. 3 spindle at 100 ppm should not exceed about 500 mPs sec and is preferably less than about 400 mPa sec, normally in the range from about 200 to about 350 mPa sec, and is a reflection of the ease of dispensing of the composition from its storage container. Whilst a measure of thickness is believed to be aestheticaly desirable, high Brookfield viscosities (i.e. >500 mPa sec) have been found to be less acceptable to consumers.

Measurements are normally made on product at a time from 48 to 96 hours, generally about 72 hours after its manufacture. The viscosity values do not normally change significantly after the composition has equilibrated but, in the case of the preferred compositions incorporating hypochlorite bleaching species, the degradation of the hypochlorite does affect the characteristics of the composition and leads to a slow reduction in viscosity and modal relaxation times. These reductions become perceptible after approximately six weeks to two months depending on the storage temperature of the compositions.

In the broadest aspect of the invention the only essential component other than the amine oxide and the alkylated benzene or naphthalene sulfonate is water which forms the remainder of the composition. Nevertheless for practical purposes, compositions embodying the present invention will normally contain other, optional, ingredients and in preferred executions of the invention these will include ionisable compounds which may be organic or inorganic in character. These ionisable compounds provide a source of ionic strength (I) which also serves to enhance the viscosity of the compositions. Levels of ionisable inorganic compounds of up to about 25% by weight of the composition can be utilised corresponding to ionic strengths of up to about 6.5 gmoles/dm$^3$, depending on the compounds employed.

In the aspect of the invention directed to liquid detergent compositions suitable for cleaning hard surfaces such as walls and windows, the ionisable compounds can include any of the water soluble inorganic and organic builder and sequestrant salts normally incorporated in such products. Compounds classifiable and well-known in the art as detergent builder salts include the nitrilotriacetates, polycarboxylates, citrates, ortho- and pyro-phosphates, silicates and mixtures of any of these. Metal ion sequestrants include all of the above, plus materials like alkali metal ethylenediaminetetraacetates, the amino-polyphosphonates and phosphates (DEQUEST). A wide variety of poly-functional organic acids and salts is disclosed in European Patent Application Publication No 0040882 which contains examples of the use of such materials in various cleaning compositions. In general the builder/sequestrant will comprise from about 1% to about 25% of the composition. Citric acid (2%–20% as sodium citrate) is a preferred builder.

In preferred embodiments of the compositions of the invention the ionisable compounds include a hypochlorite bleach and the alkali metal chloride and chlorate salts which accompany it in commercially availabe material. These salts provide the majority, and preferably all, of the ionic strength desirable for achieving viscosities of 200 cps for such compositions. An alkali metal hypochlorite content of 9–10% in the composition will normally result in an ionic strength of at least about 3.0 g moles/dm$^3$. Ionic strength values in excess of about 5.0 g moles/dm$^3$ are not desirable because of their adverse influence on the stability of the hypochlorite. Preferably the ionic strength is less than about 4.0 g moles/dm$^3$ and values in the region of from about 3.4 to about 3.8 g moles/dm$^3$ are considered to be optimum where a stable product of viscosity >200 mPa. sec. at 20° C. is desired.

The alkali metal hypochlorite may be a lithium, potassium or sodium hypochlorite and the level of hypochlorite in the composition is normally arranged to lie in the range from about 1% to about 12%, preferably from about 5% to about 10% by weight. Customarily hypochlorite bleach compositions contain approximately 6% or 9% hypochlorite is conventionally expressed in terms of the weight percentage of available chlorine in the composition, and the actual weight percentage of bleaching species is arranged to provide the desired level of 'available chlorine'. The preferred hypochlorite species is sodium hypochlorite which contains 95.3% available chlorine.

Alkali metal hypochlorites are commercially available as aqueous solutions containing from about 10% to about 15% by weight 'available chlorine' and the bulk suppliers normally produce material having available chlorine contents towards the upper end of this range viz. from 12% to 14% by weight. These commerically available hypochlorite solutions contain other salts as byproducts or contaminants, more specifically free alkalinity in the form of alkali metal hydroxide and alkali metal carbonate, and alkali metal chloride. Low levels of other species such as sodium chlorate are also believed to be formed during hypochlorite manufacture but their chemical stability is sufficiently low that they have largely decomposed by the time the hypochlorite is employed in product formulations. The levels of the byproduct materials depend on the processing conditions employed in the manufacture of the hypochlorite but in general they fall within the ranges 0.2 –1.0% alkali metal hydroxide
0.01 –0.1% alkali metal carbonate
10.0 –18.0% alkali metal chloride expressed as a weight percentage of the hypochlorite solution as supplied.

As stated hereinbefore, the salts accompanying the hypochlorite bleach provide most if not all of the ionisable species necessary for the ionic strength requirement. However, other non surface active organic or inorganic compounds can be added where necessary to provide an ionic strength in the desired range.

The ionisable compound(s) can be inorganic in nature eg. alkali metal or ammonium hydroxide, sulphate, halide, (particularly chloride), silicate carbonate, nitrate, orthophosphate, pyrophosphate, or polyphosphate, or organic such as formate, acetate or succinate. The ionisable alkali metal compound normally comprises a caustic alkali such as sodium or potassium hydroxide either alone or in admixture with alkali metal salts. For product safety reasons the amount of caustic alkali is normally limited to a value in the range of from about 0.5% to about 2%, more usually from about 0.75% to about 1.5% by weight of the composition.

In the preferred embodiments of the invention inorganic and organic compounds incorporating oxidisable groups are avoided because of their tendency to have adverse effects on physical and/or chemical stability of the compositions on storage. Certain organic sequestrants such as the amino poly (alkylene phosphonates) salts can, however, be incorporated in an oxidised form in which they are not susceptible to attack by the hypochlorite bleach. Such sequestrants are normally present in amounts of from about 0.1% to about 0.5% by weight of the composition.

The ionic strength of the composition is calculated by means of the expression $$\text{Total Ionic Strength } I = \xi \frac{C_i Z_i^2}{2}$$

where $C_i$ is the molar concentration of the ionic species in g moles/dm$^3$ $Z^i$ is the valency of the species.

The function $C_i Z_i^2$ is calculated for each of the ionic species in solution, these functions are summed and divided by two to give the composition ionic strength.

A useful optional component of the compositions of the invention is an aromatic molecule containing ring substitution in at least two positions, one substituent being a carboxylic acid group. With the exception of hydroxy group substitution, the second substituent in the aromatic ring is preferably not in the o-position. These molecules are very effective shear thinning additives although at low temperatures they do give rise to viscoelastic properties and thus are preferably used at low levels viz, not more than about 25%, preferably not more than about 10% by weight of the alkylated benzene or naphthalene sulfonate component. Examples of aromatic molecules as defined above are meta- and para-chlorobenzoic acid, meta-mitrobenzoic acid, para bromobenzoic acid, salicyclic acid, 5-sulphosalicyclic acid, 3,5-dimethyl salicyclic acid and paratoluic acid. Of the above materials the chlorobenzoic acids are preferred.

The level of use of the aromatic molecule in compositions of the invention is from about 0.01% to about 0.10% by weight of the composition.

Another optional component of compositions of the present invention is an anionic surfactant. Suitable anionic surfactants are those incorporating an aliphatic hydrocarbyl moiety having an average carbon chain length of more than about 12 and less than about 18 atoms, said moiety comprising at least about 40% by weight of the anionic surfactant. Suitable anionic surfactants satisfying this constraint include alkanoates, $C_1$–$C_{15}$ alkyl esters of sulfonated alkanoic acids, olefin sulfonates, alkyl benzene sulfonates in which the alkyl group contains 11–13 carbon atoms, s—$C_{12}$–$C_{18}$ alkane sulfonates, $C_{12}$–$C_{16}$ alkyl sulfates, certain alkyl polyethoxy sulfates, alkyl phosphates and certain alkyl ether phosphates. Mixtures of any of these surfactants can also be employed if desired.

Preferred alkanoates are the $C_{12}$–$C_{14}$ alkali metal or alkaline earth metal soaps and mixtures thereof derived from e.g. coconut or palm kernel oils. The preferred sulfonated alkanoic acid esters are alkali metal sulfonate salts of methyl, ethyl, propyl and butyl esters of $C_{12}$–$C_{14}$ alkanoic acids. Preferred olefin sulfonates are the alkali metal $C_{12}$–$C_{14}$ $\alpha$olefin sulfonates and the alkyl benzene sulfonates are preferably those with a linear alkyl chain. The alkyl sulfates may be primary or secondary in type, the alkyl group being derived from primary or secondary alcohols. In turn these alcohols may be derived from any of the sources described above in connection with the long chain group of the amine oxide. The average number of ethoxy groups in the alkyl polyethoxysulfates should not exceed about 3 per mole where the alkyl chain length is from 12 to 14 carbon atoms and about 4 per mole where the alkyl chain length is from 14 to 16 carbon atoms.

The cation is normally alkali metal, such as sodium, potassium, lithium, or ammonium, although for certain surfactants, alkaline earth metals such as magnesium can also be used.

Preferred anionic surfactants are primary $C_{12}$–$C_{16}$ alkyl sulphates with up to approximately 50% methyl branching, s—$C_{13}$–$C_{15}$ alkane sulfonates and $C_{11}$–$C_{13}$ alkyl benzene sulfonates. Soaps are also preferred anionic surfactants in mixtures in which the amine oxide: anionic surfactants weight ratio is >20:1. Where anionic surfactants are incorporated as components of the compositions of the invention, their level of use is such as to comprise from about 0.1% to about 20% by weight of the mixture of anionic surfactants and amine oxides, the latter comprising the remaining 80% to 99% of the mixture.

Another surfactant which can be incorporated in the compositions of the invention and which is also stable to hypochlorite solutions is a substituted betaine of formula $$R_5R_6R_7N^+—R_8COO^-$$

wherein $R_5$ is a $C_8$–$C_{18}$ alkyl group, preferably a $C_{10}$–$C_{14}$ alkyl group, $R_6$ and $R_7$ are $C_1$–$C_4$ alkyl groups, more preferably methyl groups, and $R_8$ is a $C_1$–$C_4$ alkylene group more preferably a $C_2$–$C_3$ alkylene group. Specific examples include octyl, decyl, dodecyl, tetradecyl and hexadecyl betaines in which $R_8$ is an ethylene or propylene group and R6 and $R_7$ are methyl groups. This surfactant can be included at levels up to about 100% of the level of the amine oxide but for cost reasons is normally incorporated at a lower level, preferably at less than about 50%, most preferably at less than about 25% of the level of the amine oxide.

A highly preferred optional component for use in the bleach-containing embodiments of the present invention is a quaternised alkoxy silane which confers a long lasting antibacterial effect on surfaces, particularly siliceous surfaces washed with the compositions. Compositions containing the organosilicon quaternary compounds are preferably free of anionic surfactants in order to avoid interaction between the two components. Where anionic surfactants are present they should comprise less than the molar amount of organosilicon quaternary compound in order to maintain the cationic character of the latter.

Organosilicon quaternary ammonium compounds having the desired combination of broad spectrum antibacterial activity and physico-chemical stability in the cleaning compositions of the invention have the general structure:

$$(R_{11})_y[R_{11}O]_{3-y}Si(CH_2)_3-\overset{\overset{R_{10}}{|}}{\underset{\underset{R_{10}}{|}}{N}}{}^{+}-R_9X^-$$

wherein $R_9$ is $C_{16}$–$C_{20}$ alkyl, $R_{10}$ is $C_1$–$C_4$ alkyl, $R_{11}$ is $C_1$–$C_4$ alkyl, y is an integer from 0 to 2, and $X^-$ is a water soluble anion. A preferred chain length for $R_9$ is $C_{18}$ for antibacterial efficacy reasons, and for reasons of cost and ease of preparation $R_{10}$ and $R_{11}$ are usually methyl. In aqueous alkaline solution the $(R_{11}O)$ groups will hydrolyse to give the silanol derivative so that references herein to the organic silicon quaternary ammonium compound include the silanol derivative thereof. $X^-$ is normally halide, particularly chloride, but can also include methosulfate, acetate or phosphate.

The level of incorporation of the organosilicon compound is from about 0.001% to about 0.25% based on the total weight of the composition but is more usually in the range of from about 0.005% to about 0.05% and most preferably from about 0.01% to about 0.03% by weight.

A desirable optional component of compositions in accordance with the invention is a perfume which is present at a level of from about 0.01% to about 0.5% preferably from about 0.05% to about 0.25% by weight of the composition.

Monocyclic and bicyclic monoterpene alcohols and their esters with $C_2$–$C_3$ alkanoic acids are known and used as ingredients in fragrances, including those employed in detergent compositons. As such their level of incorporation varies from about 10 to about 500 ppm of the composition depending on the perfume formulation and the nature of the detergent composition.

It has been found that in aqueous hypochlorite bleach solutions containing from about 1.0% to about 2.5% of a $C_{14}$–$C_{16}$ amine oxide as the only surfactant, the incorporation of at least about 400 ppm of at least one monocyclic or bicyclic monoterpene alcohol or the ester thereof with $C_2$–$C_3$ alkanoic acid provides an enhancement of the viscosity of the bleach solution and facilitates the generation of viscosities of 200 mPa sec. and greater at 20° C. Preferably the monoterpene alcohol or ester is present in an amount of at least about 600 ppm. Examples of materials demonstrating this effect are isoborneol, isobornyl acetate, dihydroterpineol and dihydroterpinyl acetate.

The mode of operation of these materials in this system is not fully understood but it is hypothesised that in the absence of anionic surfactants, hydrogen bonding occurs between adjacent alcohol functions of the relatively water insoluble terpene alcohols held in the amine oxide micelles. This leads to the formation of an extended micellar structure in the solution which provides an increased viscosity.

Thickened aqueous hypochlorite bleach compositions in accordance with the present invention and including the above mentioned terpene alcohol derivatives are particularly preferred for the incorporation of quaternised alkoxy silane as an antibacterial component. Such compositions utilise the minimum amounts of amine oxide surfactant and ionic salts necessary to generate the desired product viscosity and hence enhance the stability of the quaternised alkoxy silanes.

The compositions can be made by conventional mixing techniques but, because of the relatively low aqueous solubility of the aromatic viscosity enhancing compound, the amine oxide should be present in the solution to which the viscosity enhancing compound is added. In the preferred compositions the following method of preparation is highly preferred, in order to ensure that problems of incomplete solution, and/or precipitation on storage, do not arise.

In the preferred mode of preparation, a premix of the amine oxide, perfume, added caustic alkali and water is formed at ambient temperature (viz. 15°–25° C.) and the alkylated benzene or naphthalene sulfonate compound is then added with vigorous agitation. Where an organosilicon compound is included it will also be added at this stage. In the preferred thickened bleach compositions incorporating a monocyclic or bicyclic monoterpene alcohol component, this can conveniently be incorporated in the perfume mixture. The premix is then added to a solution of the remaining ingredients e.g. hypochlorite, other surfactants, ionisable inorganic or organic compounds, chelants, etc. to make the final product.

The invention is illustrated in the following examples in which percentages are expressed by weight of the composition unless otherwise stated.

EXAMPLE 1

20.525 g of a 28.6% solution of $C_{14}$ linear alkyl dimethyl amine oxide was added to 166.965 g of demineralised water and 0.625 g of a perfume material containing 0.32 g of isobornyl acetate was dispersed therein. Tc this solution was slowly added, with vigorous agitation, 1.25 g of sodium cumene sulfonate as a crystalline powder to form 200 g of a premix solution. 10.635 g of a 47% sodium hydroxide solution was dissolved in 300 g of sodium hypochlorite solution (15.0% $AvCl_2$ solution supplied by ICI Ltd) and the premix was then blended with high shear agitation into this solution.

The resultant composition had the following analysis:

| | |
|---|---|
| NaOCl | 8.57 (= 9.0% Av $Cl_2$) |
| NaCl | 8.54 |
| NaOH | 1.00 |
| Amine Oxide | 1.16 |
| NaCumene Sulfonate | 0.25 |
| Perfume | 0.125 |
| Water & Misc. | 80.355 |

The calculated ionic strength was 3.3 g moles/$dm^3$ and the composition exhibited a Brookfield viscosity of 312 mPa sec at 20° C. on 72 hour old product.

When examined using the Carrimed Rheometer, the composition displayed the following characteristics:

| Temperature °C. | 6° | 10° | 14° | 18° |
|---|---|---|---|---|
| Zero shear viscosity mPa sec | 4600 | 2850 | 1330 | 750 |
| Modal relaxation time sec | 0.51 | 0.31 | 0.16 | 0.16 |

A comparative composition was also made using the same preparative procedure but incorporating an amine oxide level of 1.00%, 0.1% by weight of p-chloro benzoic acid as a shear thinning additive and no alkylated benzene sulfonate. This composition had a Brookfield viscosity of 231 mPa sec at 20° C. on 72 hour old product and displayed the following zero shear viscosity and modal relaxation time values:

| Temperature °C. | 6 | 10 | 14 | 18 |
|---|---|---|---|---|
| Zero shear viscosity mPa sec | 3800 | 2600 | 1700 | 1140 |
| Modal relaxation time sec | 1.08 | 0.62 | 0.38 | 0.23 |

The comparative composition displayed high viscosities at zero shear but these was accompanied by significantly higher modal relaxation times than were exhibited by the composition in accordance with the invention.

EXAMPLE 2

Using the technique of Example 1 a composition having the following analysis was prepared:

| | | |
|---|---|---|
| NaOCl | 8.57 | |
| NaCl | 8.54 | |
| NaOH | 1.0 | |
| Linear alkyl dimethyl $C_{14}$ Amine oxide | 1.0 | |
| sodium xylene sulfonate | 0.1 | |
| Perfume** | 0.125 | (including 0.064 g isobornyl acetate) |
| Water & Misc. | 80.665 | |
| | 100.000 | |

**Incorporating a mixture of monoterpene alcohols and esters thereof in an amount corresponding to approximately 950 ppm on a composition basis.

This composition had a calculated ionic strength of 3.28 g moles/$dm^3$ and gave a Brookfield viscosity of 290 mPa sec at 20° C. on 72 hour old product. The zero shear viscosity at 10° C. was found to be 950 mPa sec with a modal relaxation time of 0.18 seconds at 10° C.

EXAMPLE 3

An identical composition to that in Example 2 was made with the exception that the sodium xylene sulfonate was replaced by sodium toluene sulfonate. This gave a Brookfield viscosity of 270 mPa sec at 20° C. on 72 hour old product and when tested in the Rheometer gave a zero shear viscosity at 10° C. of 650 mPa sec with a modal relaxation time of 0.16 seconds at 10° C.

EXAMPLE 4

The composition of Example 1 was taken and p-chlorobenzoic acid added in an amount of 0.025% by weight of the product, i.e. a level of 10% by weight of the sodium cumene sulfonate. The viscosity as measured by the Brookfield viscometer was 320 mPa seconds at 20° C. on 72 hour old product. When tested in the Carrimed Rheometer, the following measurements were obtained:

| Temperature °C. | 6 | 10 | 14 | 18 |
|---|---|---|---|---|
| Zero shear viscosity mPa sec | 5800 | 3100 | 1710 | 810 |
| Modal relaxation time | 0.68 | 0.33 | 0.24 | 0.16 |

The addition of a low level of p-chlorobenzoic acid can be seen to assist in maintaining a high viscosity (relative to the composition of Example 1) under zero shear conditions, particularly towards the upper end of the tested temperature range. However, the modal relaxation times also show an increase relative to that in Example 1 at the low end of the temperature range, and thus the use of more than minor amounts of substituted aromatic acids of U.S. Pat. No. 4 576 728 is not preferred.

What I claim is:

1. A thickened aqueous cleaning composition consisting essentially of (a) from about 0.1% to about 5% by weight of a tertiary amine oxide of formula $R_1R_2R_3N \rightarrow O$ wherein $R_1$ is a $C_{12}$–$C_{15}$ linear or branched alkyl group and $R_2$ and $R_3$ are independently selected from $C_1$–C4 alkyl groups and $C_2$–$C_4$ hydroxyl alkyl groups;

(b) from about 0.05% to about 0.5% by weight of an alkali metal or alkaline earth metal mono or polyalkylated benzene or naphthalene sulfonate in which the alkyl groups contain from 1 to 4 carbon atoms;

(c) from 0% to about 25% by weight of ionisable non surface active organic, or inorganic compounds; the weight ratio of a:b lying in the range from about 2.5:1 to about 10:1, said composition exhibiting a zero shear viscosity of at least about 500 mPa.sec at 10° C., a Brookfield viscosity of less than about 500 mPa sec using a No. 3 spindle at 20° C., and a modal relaxation time of about 0.5 seconds maximum at 10° C.

2. A thickened aqueous cleaning composition according to claim 1 wherein component (b) is present in an amount of from about 0.01% to about 0.25% by weight.

3. A thickened aqueous cleaning composition according to claim 1 wherein component (b) is selected from sodium xylene sulfonate and sodium cumene sulfonate.

4. A thickened aqueous cleaning composition according to claim 1 further including from about 0.01% to about 0.1% by weight of a compound selected from salicylic acid and its 5-sulfo and 3,5-dimethyl derivatives, m- and p-chloro benzoic acid, p-bromobenzoic acid, p-toluic acid and m-nitrobenzoic acid and mixtures thereof, provided that the weight of the compound does not exceed about 25% by weight of the alkali metal benzene or naphthalene sulfonate present.

5. A thickened aqueous cleaning composition according to claim 4 wherein the compound is selected from m- and p- chlorobenzoic acids.

6. A thickened aqueous cleaning composition according to claim 1 incorporating an auxiliary surfactant in an amount not exceeding the amount of amine oxide present.

7. A thickened aqueous cleaning composition according to claim 6 wherein the auxiliary surfactant is an anionic surfactant selected from alkali or alkaline earth metal alkanoates, $C_{11}$–$C_{13}$ alkyl benzene sulfonates, s—$C_{12}$–$C_{18}$–alkane sulfonates, $C_{12}$–$C_{16}$ alkyl sulphates and ethoxylated derivatives thereof containing not more than four ethoxy groups per mole, and mixtures of any of the foregoing, the auxiliary surfactant being present in an amount of from about 0.1% to about 20% by weight of the mixture of amine oxide and anionic surfactants.

8. A thickened aqueous cleaning composition according to any one of claims 1 wherein the non surface active organic, or inorganic ionisable compounds are selected from alkali metal or ammonium citrate, formate, acetate or succinate, hydroxide, sulfate, chloride, hypochlorite, carbonate, nitrate, orthophosphate, pyrophosphate, polyphosphate, amino polycarboxylate, amino polyphosphonate and mixtures of any thereof.

9. A thickened aqueous cleaning composition consisting essentially of (a) from about 0.1% to about 5% by weight of a tertiary amine oxide of formula $R_1R_2R_3N \rightarrow O$ wherein $R_1$ is a $C_{12}$–$C_{15}$ linear or branched alkyl group and $R_2$ and $R_3$ are independently selected from $C_1$–$C_4$ alkyl groups and $C_2$–$C_4$ hydroxyl alkyl groups;

(b) from about 0.01% to about 0.25% by weight of an alkali metal or alkaline earth metal mono or polyalkylated benzene or naphthalene sulfonate in which the alkyl groups contain from 1 to 4 carbon atoms;

(c) from 0% to about 25% by weight of non surface active organic or inorganic ionisable compounds selected from alkali metal or ammonium citrate, formate, acetate or succinate, hydroxide, sulfate, chloride, hypochlorite, carbonate, nitrate, orthophosphate, pyrophosphate, polyphosphate, amino polycarboxylate, amino polyphosphonate and mixtures of any thereof.

the amino oxide component (a) comprising the sole surfactant species present, the weight of ratio a:b lying in the range from about 2.5:1 to about 10:1, said composition exhibiting a zero shear viscosity of at least about 500 mPa.sec at 10° C., a Brookfield viscosity of less than about 500 mPa sec using a No. 3 spindle at 20°C., and a modal relaxation time of about 0.5 seconds maximum at 10° C.

10. A thickened aqueous cleaning composition according to claim 9 wherein $R_1$ is a linear alkyl group having an average carbon chain length in the range $C_{14}$–$C_{15}$.

11. A thickened aqueous cleaning composition according to claim 10 wherein component (c) provides an ionic strength of not more than 5.0 g moles/dm$^3$.

12. A thickened aqueous cleaning composition according to claim 11 wherein component (c) comprises a mixture of sodium hypochlorite, sodium chloride and sodium hydroxide.

13. A thickened aqueous cleaning composition according to claim 12 wherein the hypochlorite is present in an amount from about 1 to about 10% by weight, the sodium chloride is present in an amount of from about 1 to about 10% by weight and the sodium hydroxide is present in an amount of from about 0.5% to about 1.5% by weight.

14. A thickened aqueous cleaning composition according to claim 12 incorporating at least about 400 ppm of at least one monocyclic or bicyclic monoterpene alcohol or the ester thereof with a $C_2$–$C_3$ alkanoic acid.

15. A thickened aqueous cleaning composition according to claim 12 incorporating from about 0.001% to about 0.25% based on the total weight of the composition of an organo silicon quaternary compound of formula $$(R_{11})_y[R_{11}O]_{3-y}Si(CH_2)_3-\overset{\overset{R_{10}}{|}}{\underset{\underset{R_{10}}{|}}{N^+}}-R_9X^-$$

wherein $R_9$ is $C_{16}$–$C_{20}$ alkyl $R_{10}$ is $C_1$–$C_4$ alkyl $R_{11}$ is $C_1$–$C_4$ alkyl y is an integer from 0 to 2 and $X^-$ is a water soluble anion.

* * * * *

UNITED STATES PATENT AND TRADEMARK OFFICE

CERTIFICATE OF CORRECTION

PATENT NO. : 4,783,283

DATED : November 8, 1988

INVENTOR(S) : Barry Stoddart

It is certified that error appears in the above-identified patent and that said Letters Patent is hereby corrected as shown below:

Col. 2, line 53, "reading" should be -- readings --.

Col. 6, line 30, after "hypochlorite" add the following -- by weight. However, the activity of chlorine bleaching compositions --.

Col. 10, line 31, "28.6%" should read -- 28.26% --.

Signed and Sealed this

Twenty-sixth Day of December, 1989

*Attest:*

JEFFREY M. SAMUELS

*Attesting Officer* *Acting Commissioner of Patents and Trademarks*